US012091933B2

(12) United States Patent
Freeman

(10) Patent No.: US 12,091,933 B2
(45) **Date of Patent: *Sep. 17, 2024**

(54) ANNULAR FLOW LUBRICATOR METHOD AND APPARATUS

(71) Applicant: Epic Lift Systems, Houston, TX (US)

(72) Inventor: Shannon Freeman, Tomball, TX (US)

(73) Assignee: Epic Lift Systems, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/505,891

(22) Filed: Nov. 9, 2023

(65) Prior Publication Data

US 2024/0076952 A1 Mar. 7, 2024

Related U.S. Application Data

(63) Continuation of application No. 17/987,428, filed on Nov. 15, 2022, now Pat. No. 11,851,980.

(60) Provisional application No. 63/286,438, filed on Dec. 6, 2021.

(51) Int. Cl.

| | |
|---|---|
| ***E21B 34/02*** | (2006.01) |
| ***F04B 47/12*** | (2006.01) |
| ***F04B 53/14*** | (2006.01) |
| ***F16N 11/04*** | (2006.01) |

(52) U.S. Cl.

CPC ..... *E21B 34/02* (2013.01)

(58) Field of Classification Search

None

See application file for complete search history.

(56) References Cited

U.S. PATENT DOCUMENTS

| | | | | |
|---|---|---|---|---|
| 4,417,858 | A * | 11/1983 | Stout | F04B 47/12 417/58 |
| 7,073,532 | B2 | 7/2006 | Bowe | |
| 7,134,503 | B2 | 11/2006 | Lee | |
| 7,954,545 | B2 | 6/2011 | Hearn et al. | |
| 8,627,892 | B2 | 1/2014 | Nadkrynechny | |
| 11,447,049 | B2 | 9/2022 | Sekizuka | |
| 11,851,980 | B2 * | 12/2023 | Freeman | E21B 33/068 |
| 2006/0124292 | A1 * | 6/2006 | Victor | E21B 43/121 166/105 |
| 2009/0188673 | A1 | 7/2009 | Hearn et al. | |
| 2012/0318524 | A1 | 12/2012 | Lea, Jr. | |
| 2020/0116303 | A1 * | 4/2020 | Roberts | F04B 47/12 |
| 2021/0054839 | A1 * | 2/2021 | Kegin | F16N 7/385 |
| 2022/0290499 | A1 * | 9/2022 | Geldenhuys | F16N 7/14 |
| 2022/0390499 | A1 | 12/2022 | Youngblood, Jr. | |

* cited by examiner

*Primary Examiner* — Matthew R Buck
*Assistant Examiner* — Douglas S Wood
(74) *Attorney, Agent, or Firm* — Park, Vaughan, Fleming & Dowler LLP

(57) ABSTRACT

Described herein are embodiments of apparatuses and methods that include an annular flow lubricator. In an exemplary embodiment, the annular flow lubricator includes a body housing an internal flow tube such that well flow enters a lower portion of the internal flow tube, travels up the internal flow tube, and exits an upper portion of the internal flow tube. Upon exiting the upper portion of the internal flow tube, well flow then travels in an annulus between the body of the lubricator and a wall of the internal flow tube before exiting an outlet port of the lubricator.

36 Claims, 23 Drawing Sheets

SECTION A-A

SECTION B - B

SECTION C - C

SECTION G - G

ANNULAR FLOW LUBRICATOR METHOD AND APPARATUS

PRIORITY CLAIM

This application is a continuation of and claims priority to application Ser. No. 17/987,428 filed Nov. 15, 2022, which claims priority to provisional patent application Ser. No. 63/286,438 filed Dec. 6, 2021, which is fully incorporated herein by reference.

TECHNICAL FIELD OF THE INVENTION

Embodiments of the subject matter disclosed herein relate to an improved wellhead lubricator and components thereof, including methods of operating and using the same.

DISCUSSION OF THE BACKGROUND

It is well known that production from oil and gas wells requires the diversion of produced materials at the wellhead. Various methods and devices have been developed to for that purpose. The present invention assists in that process by providing a new annular flow sleeve for use in a lubricator that overcomes prior art problems associated with such lubricators and associated flow paths.

SUMMARY

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is later discussed.

Described herein are exemplary embodiments of systems and apparatuses, and methods of use, that include a wellhead lubricator having an internal, annular flow path for diverting liquids. The internal, annular flow path is assisted by the use of an internal flow tube that is easily accessed for quick interchange and may preclude the need to include additional/other flow paths traditionally used to divert liquids from the lubricator.

BRIEF DESCRIPTION OF THE DRAWINGS

The following disclosure may be understood by reference to the following description taken in conjunction with the accompanying drawings, in which like reference numerals identify like elements. The accompanying drawings, which are incorporated herein and constitute a part of the specification, illustrate one or more exemplary embodiments of the present invention, except where the drawings are indicated to illustrate the prior art. In the drawings.

DETAILED DESCRIPTION

Various features and advantageous details are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended or implied. To the extent that a term or phrase is intended to have a special meaning, i.e., a meaning other than that understood by skilled artisans, such special definition will be expressly set forth in the specification in a definitional manner that directly and unequivocally provides the special definition for the term or phrase.

Figure 1:
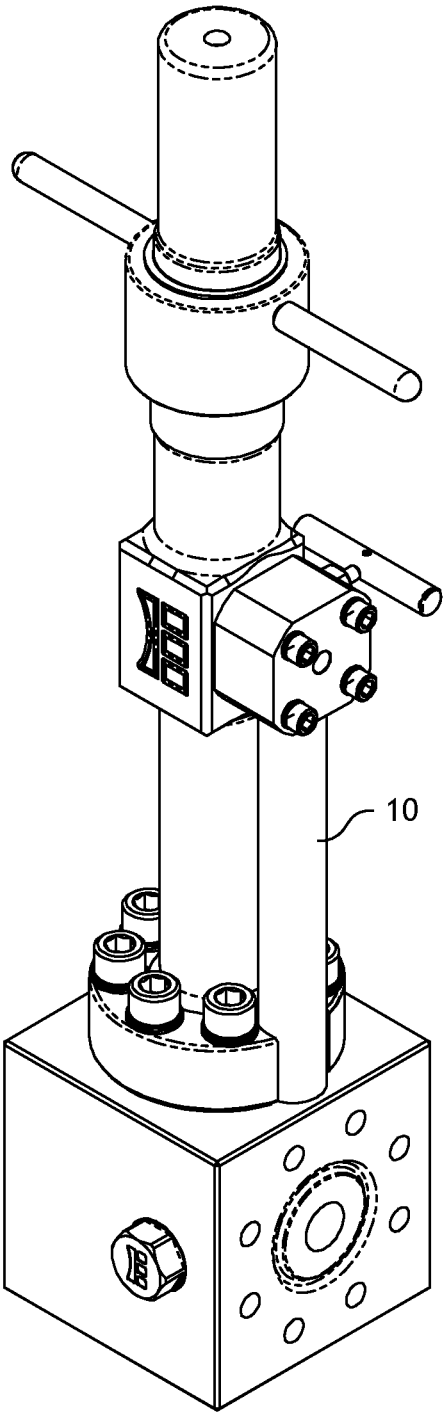
FIG. 1 PRIOR ART
FIG. 1 is a perspective view of a prior art manifold block and lubricator.

The present exemplary embodiments describe an annular flow lubricator and methods for using the same. In order to illustrate the utility and inventive nature of the disclosed embodiments, references to certain prior art embodiments are herein described. For example, FIG. 1 is a perspective view of a prior art manifold block and lubricator. Those skilled in the art will appreciate its structure and function, including the separate flow path 10. As will be appreciated, separate flow path 10 is used to divert liquids received into the lubricator from the well. Here, liquids are received from the well and travel (or are pushed) to the top of the lubricator where they are then diverted into flow path 10. Once diverted into flow path 10, the liquids travel down flow path 10 and into another flow path (shown in FIG. 3), where the liquids can then be dealt with as the operator chooses. The additional flanges, connections, welds, and components (including their geometrical demands imposed on the well head and positioning of other components) associated with such diversionary flow paths like flow path 10 have been seen by the inventor as an inefficiency for which the present invention provides a solution.

Figure 2:
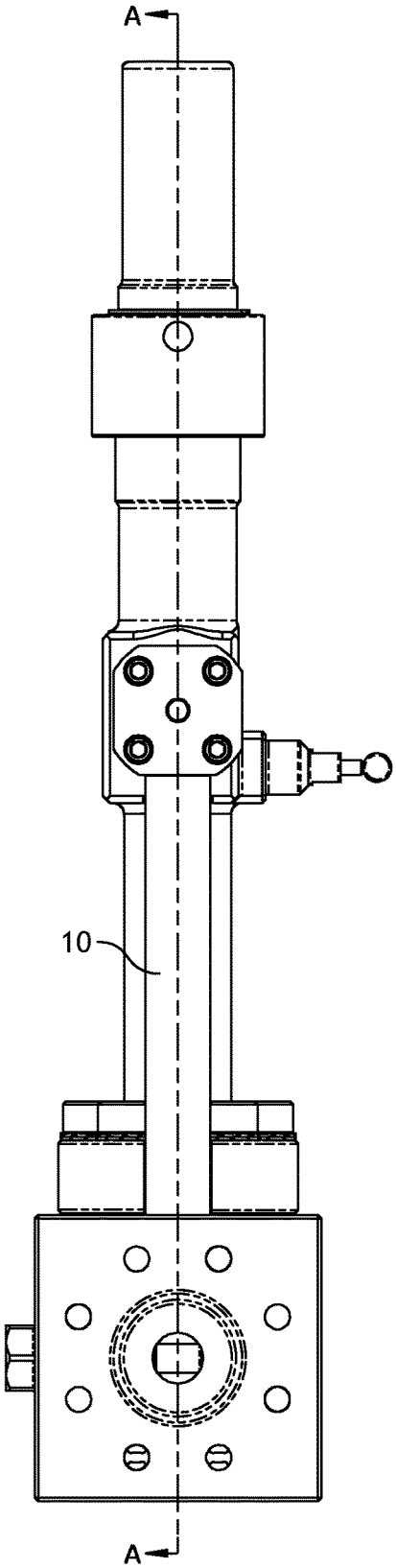
FIG. 2 PRIOR ART
FIG. 2 is a front view of a prior art manifold block and lubricator.
Figure 3:
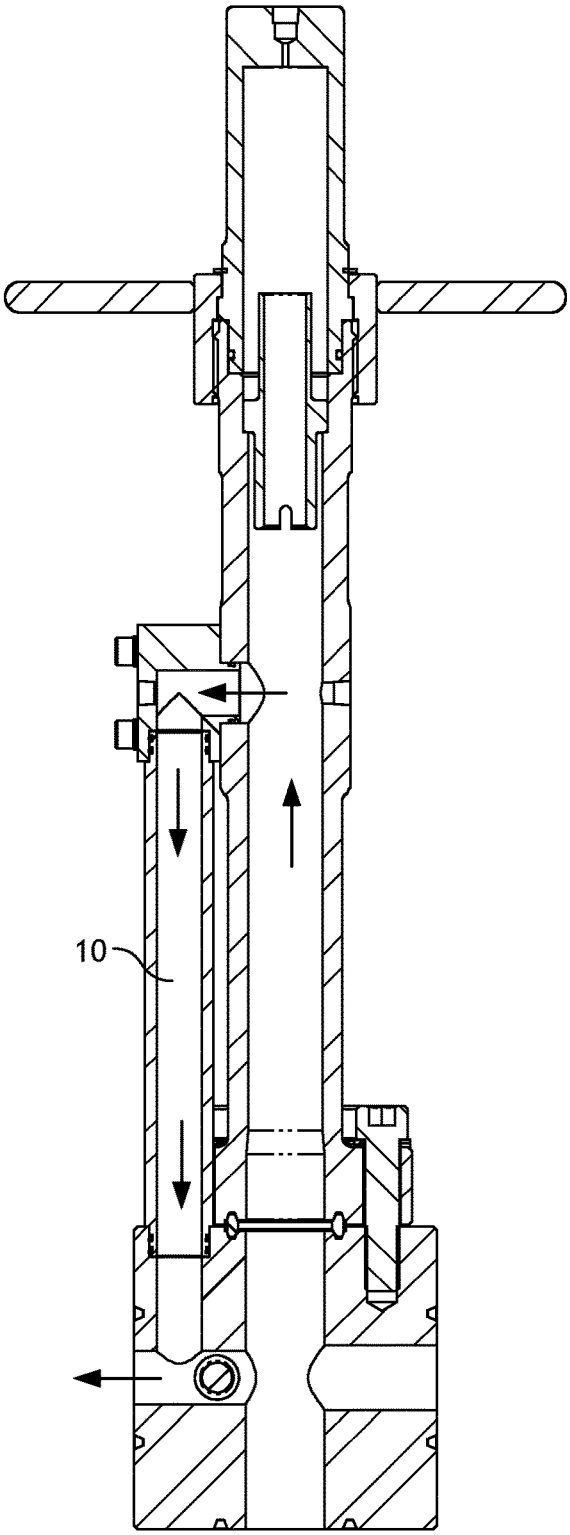
FIG. 3 PRIOR ART
FIG. 3 is a cross-section along section line A-A of the prior art manifold block and lubricator shown in FIG. 2.

FIG. 2 is a front view of the prior art manifold block and lubricator shown in FIG. 1. FIG. 3 is a cross-section taken along section line A-A of the prior art manifold block and lubricator shown in FIG. 2. FIG. 3 better illustrates the flow path that liquids use to exit the lubricator through the flow path on the bottom left of the wellhead block. Arrows in the flow path have been added to FIG. 3 to show the travel path of the received and exiting liquids.

Figure 4:
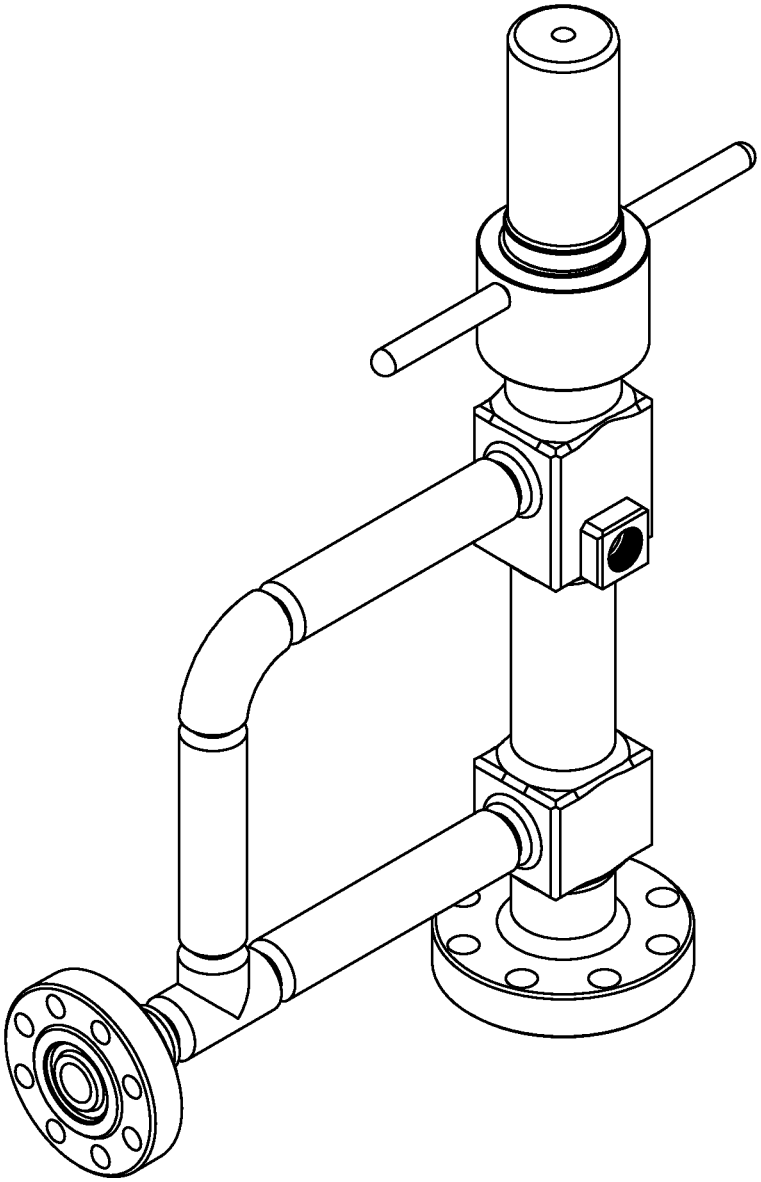
FIG. 4 PRIOR ART
FIG. 4 is a perspective view of a prior art lubricator.
Figure 5:
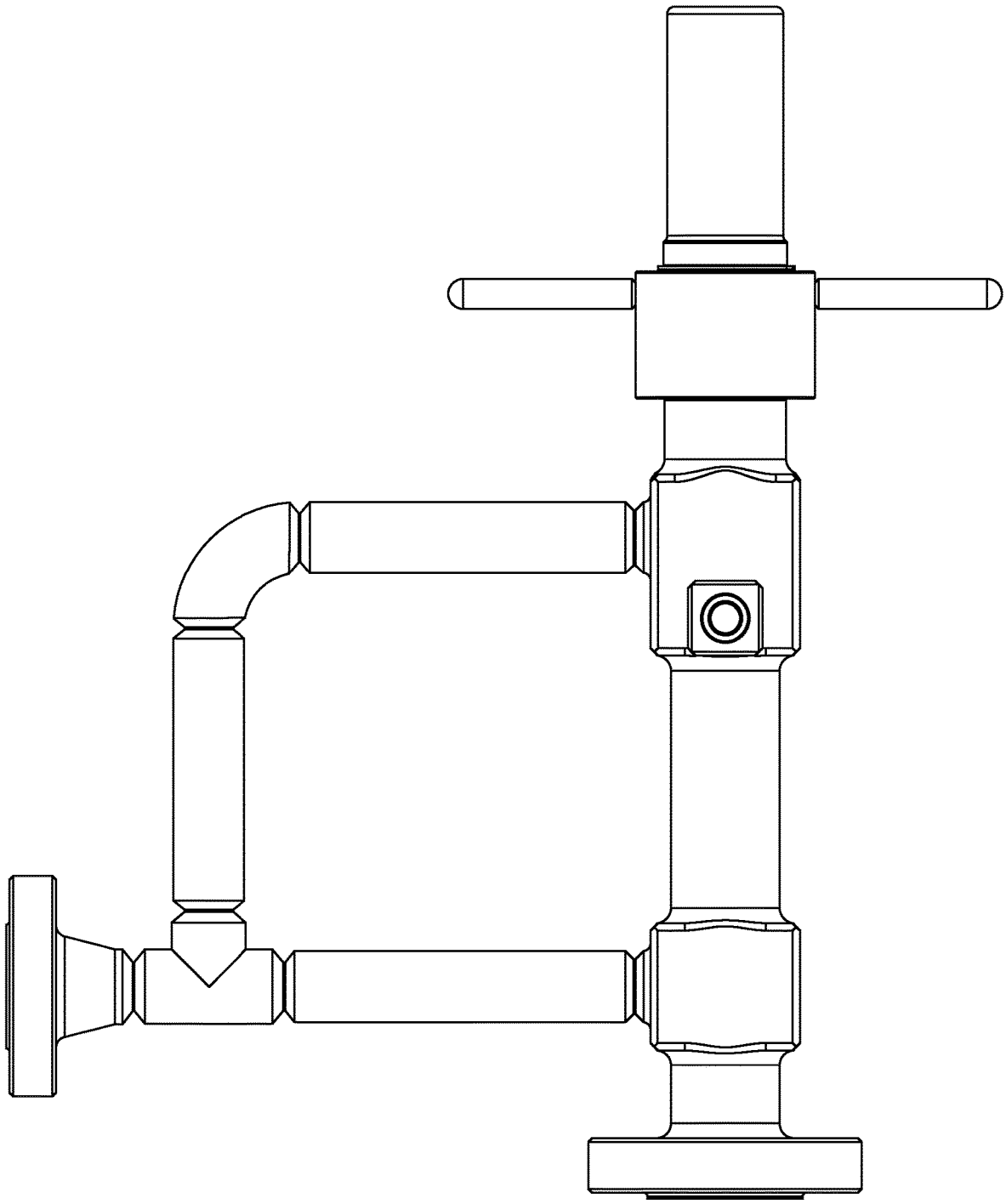
FIG. 5 PRIOR ART
FIG. 5 is a front view of a prior art lubricator.
Figure 6:
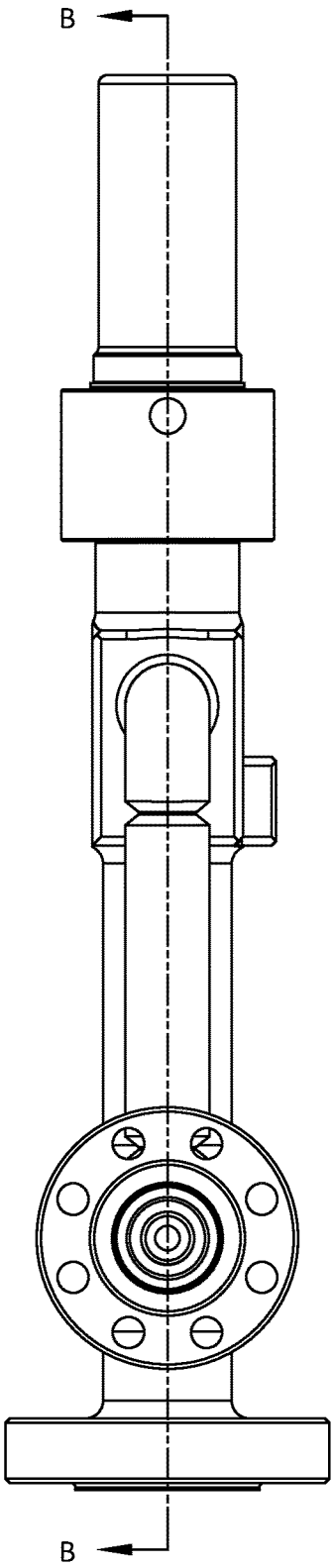
FIG. 6 PRIOR ART
FIG. 6 is a side view of a prior art lubricator.
Figure 7:
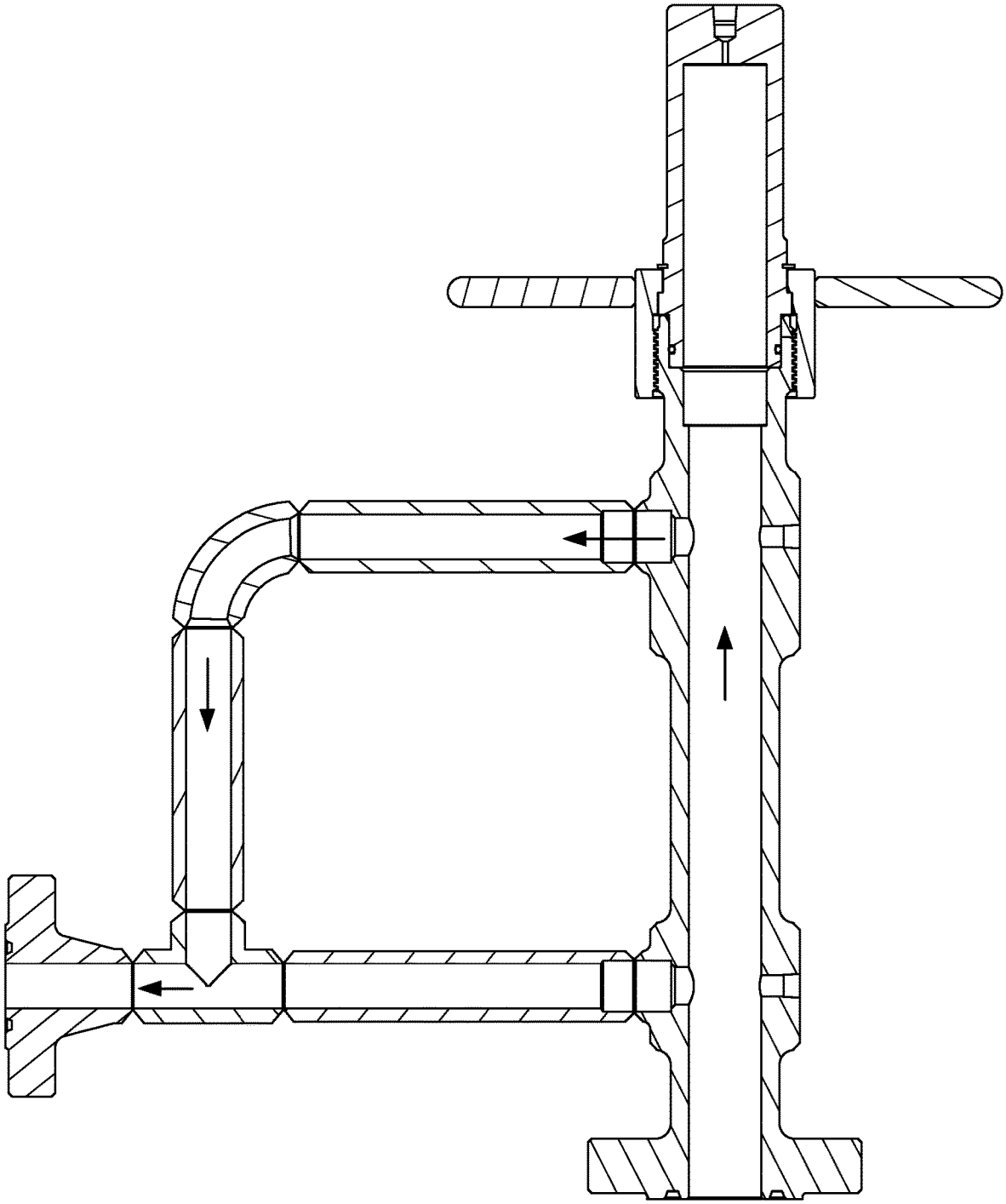
FIG. 7 PRIOR ART
FIG. 7 is a cross-section along section line B-B of the prior art lubricator shown in FIG. 6.

FIG. 4 is a perspective view of another prior art lubricator. This lubricator operates functionally similar to that of FIGS. 1-3 but has a different profile and footprint on the wellhead. As those skilled in the art will appreciate, its drawbacks and limitations are similar to the lubricator of FIGS. 1-3, which are remedied by certain aspects and embodiments of the present invention as described in more detail below. FIG. 5 is a front view of the prior art lubricator of FIG. 4, and FIG. 6 is a side view of the prior art lubricator of FIG. 4. FIG. 7 is a cross-section along section line B-B of the prior art lubricator shown in FIG. 6. Arrows in the flow path have been added to FIG. 7 to show the travel path of the received and exiting liquids.

Figure 8:
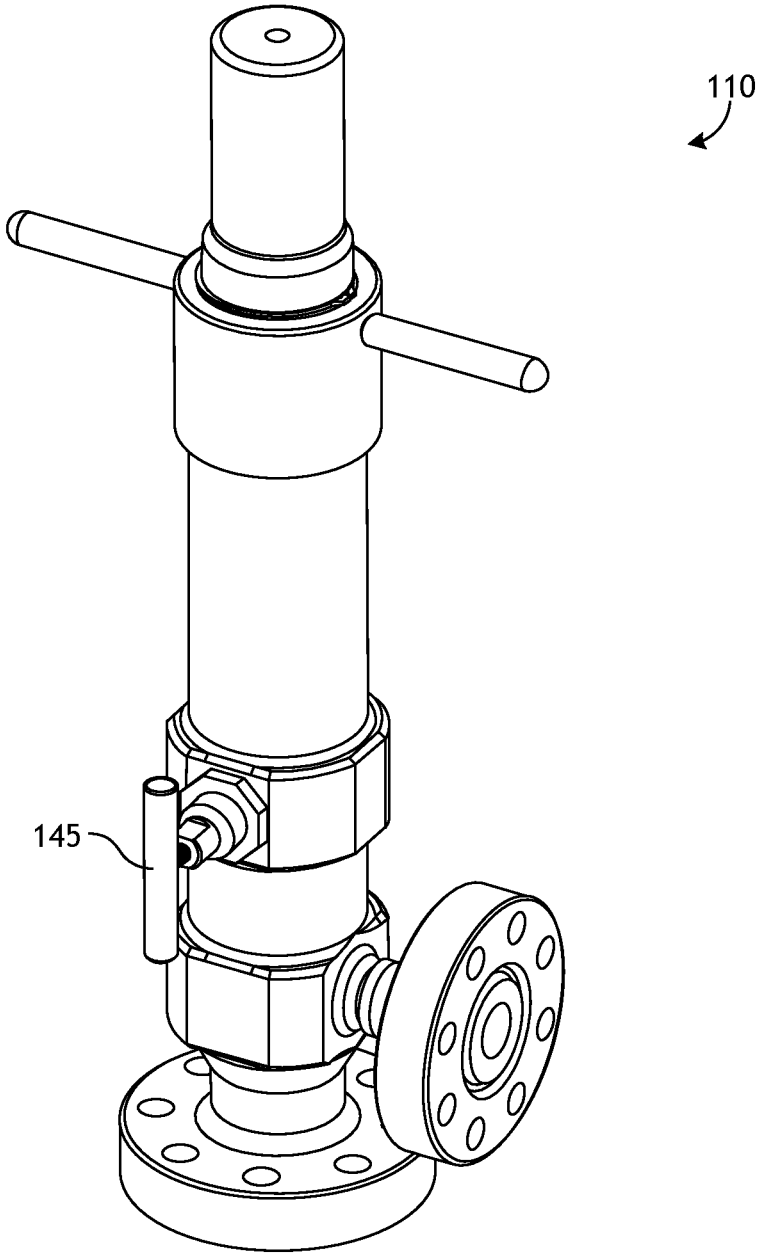
FIG. 8 is a perspective view of a new lubricator.
Figure 9:
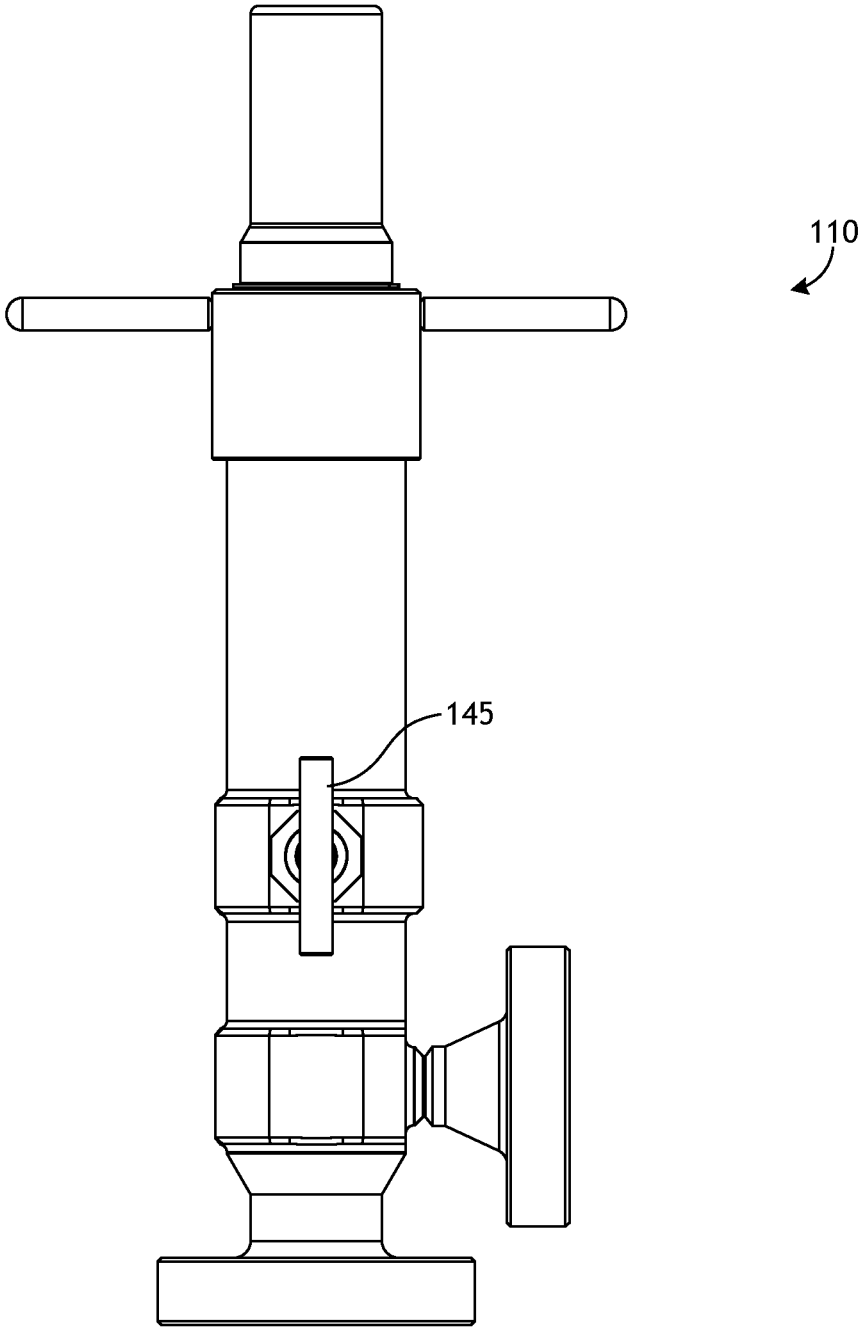
FIG. 9 is a left side view of a new lubricator.
Figure 10:
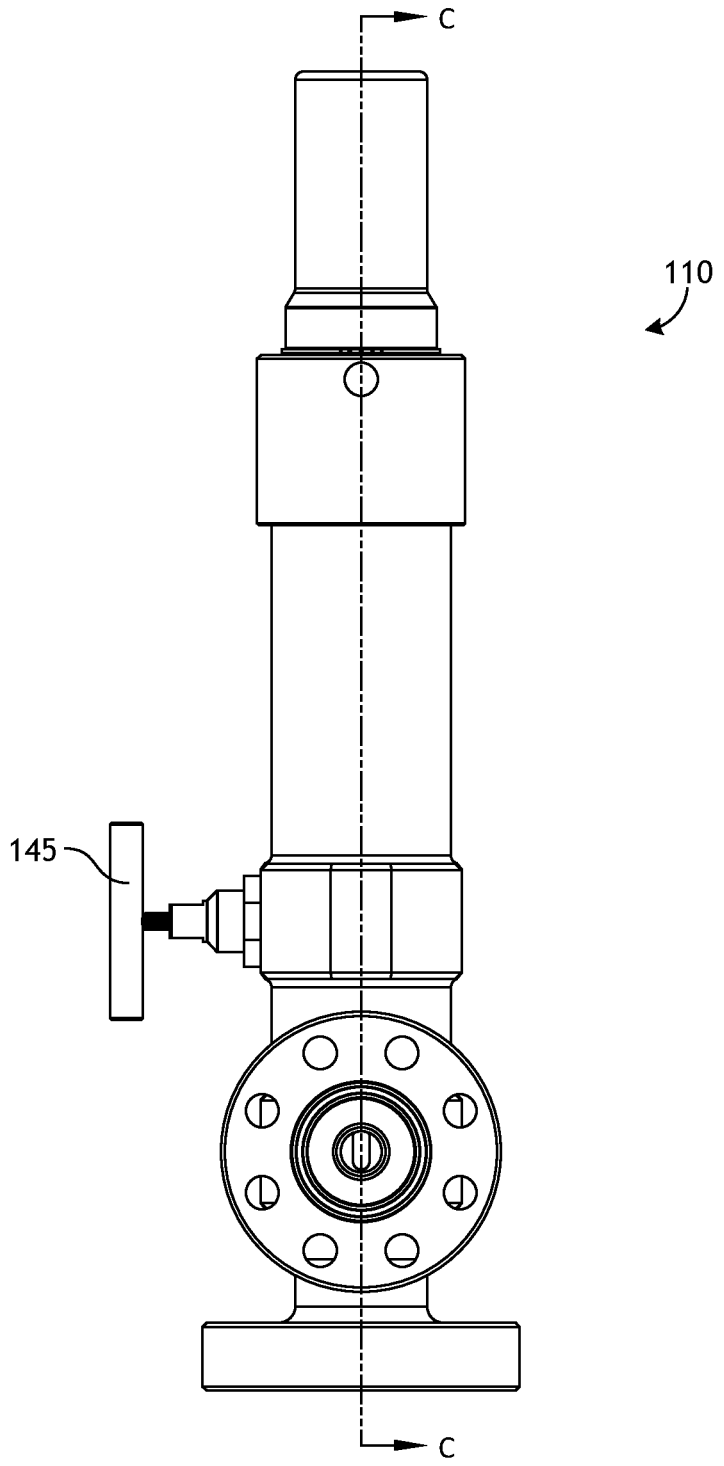
FIG. 10 is a front view of a new lubricator.
Figure 11:
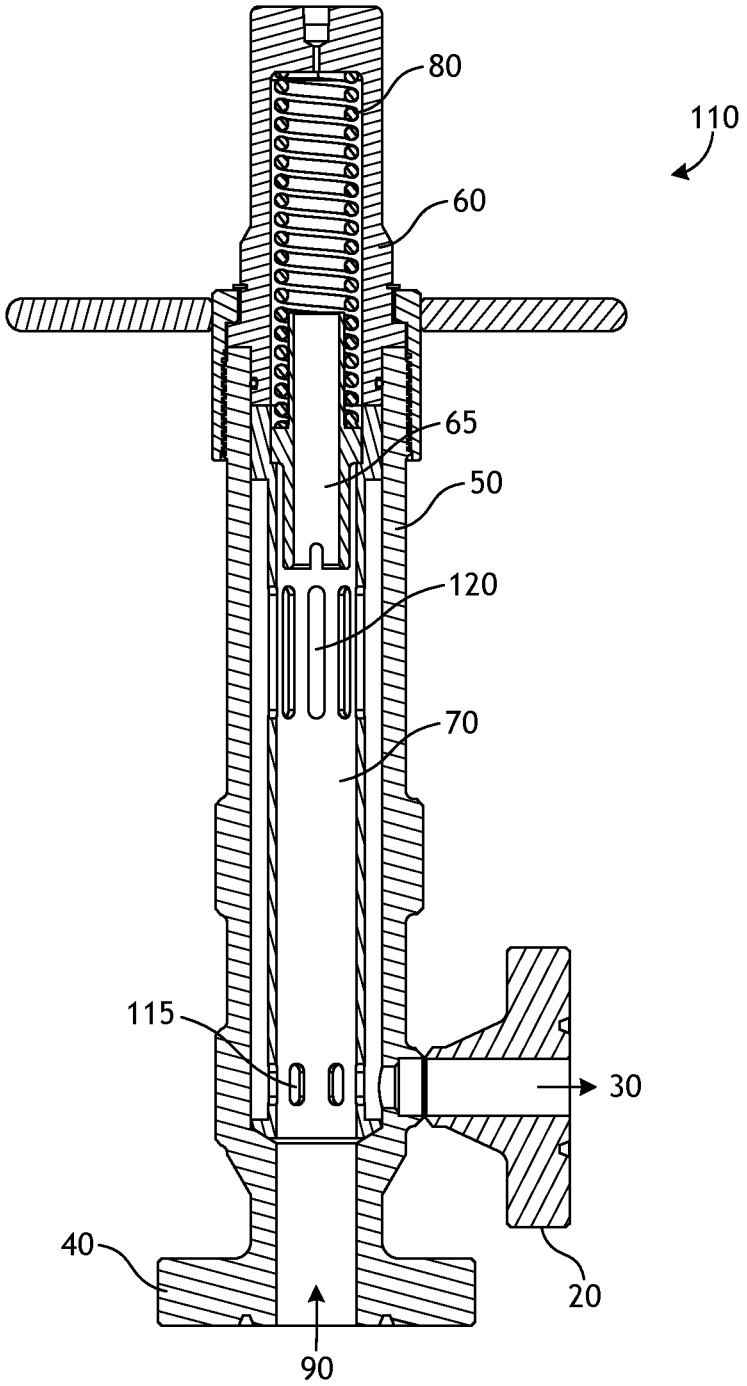
FIG. 11 is a cross-section along section line C-C of the new lubricator shown in FIG. 10.

FIG. 8 is a perspective view of an exemplary embodiment of a new lubricator 110 including an exemplary embodiment of the present invention. As can be seen, the embodiment of FIG. 8 reduces the number of flanges, connections, welds, and components (including their geometrical demands imposed on the well head and positioning of other components) relative to the prior art lubricator configurations of FIGS. 1-7. FIG. 9 is a left side view of the lubricator of FIG. 8, and FIG. 10 is a front view of the same. FIG. 11 is a cross-section along section line C-C of the new lubricator shown in FIG. 10.

FIG. 11 shows some of the fundamental components of lubricator 110. Not all such components are critical to the invention, as will be appreciated by those skilled in the art from a review of this disclosure in combination with the appended claims. Among the components of lubricator 110 are body 50, cap 60, and anvil 65. While not shown, anvil 65 can include a protruding reset rod extending down into the lubricator body. The reset rod can serve to change the position of a valve element (e.g., a dart, ball, or other plunger restriction device) in a bypass plunger. In addition to being integrated into the anvil, the reset rod can alternatively be a separate element that protrudes through the anvil to provide the described function.

Removing cap 60 from body 50 (via, for example, a threaded connection shown in more detail in FIGS. 11, 18, 21, and 28) provides ready access to the internal components of the lubricator, such as anvil 65, end cap spring 80, and internal flow tube 70. Outlet flange 20 and inlet flange 40 can be forged as a single unit with body 50, or they may be welded to body 50, or they may be connected to body 50 in ways otherwise known to those skilled in the art. Moreover, they need not be connected to body 50 in the same manner as one another. Flow out of lubricator 110 typically is through one or more outlets, including at least outlet port 30 as illustrated by FIG. 11.

In operation, flow from the well will enter lubricator 110 through a bore in bottom flange 40 and extending upward through the central bore/portion of the lubricator as designated at 90 in FIG. 11. This flow can be with or without the assistance of some sort of artificial lift, including a plunger. As the flow enters the bore of bottom flange 40, it flows upward and into the bottom inlet of inner flow tube 70. While some of that flow will be directed out of lower outlet ports 115 and then out of the lubricator via outlet port 30, a larger portion of the flow typically will flow up the inner bore of internal flow tube 70 and then out upper outlet ports 120 of the inner flow tube. From there, the flow will flow down an annulus formed between the outside of inner flow tube 70 and the interior sidewall of lubricator 110. The flow will continue in this manner until it exits the lubricator at outlet port 30.

Figure 12:
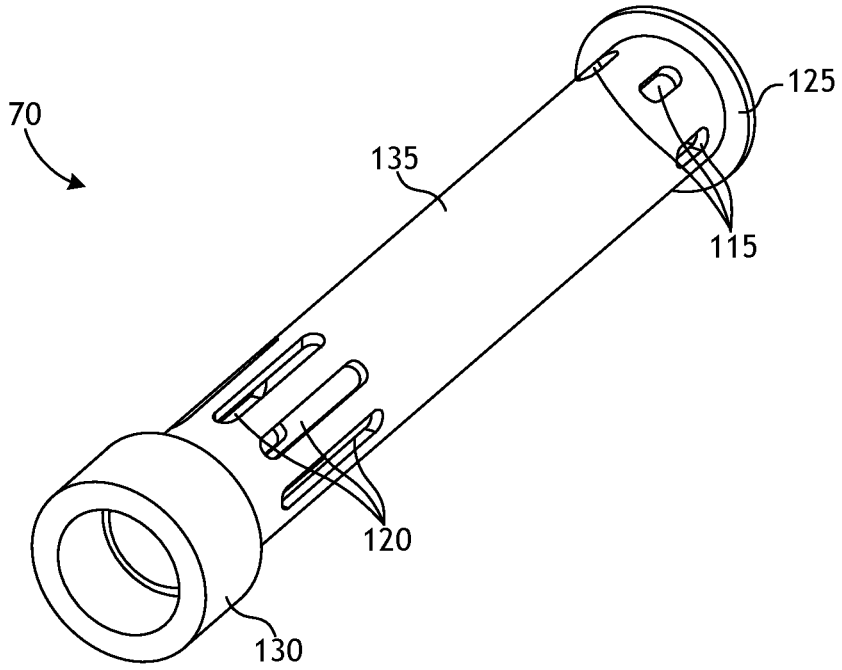
FIG. 12 is a perspective view of an internal flow tube.
Figure 13:
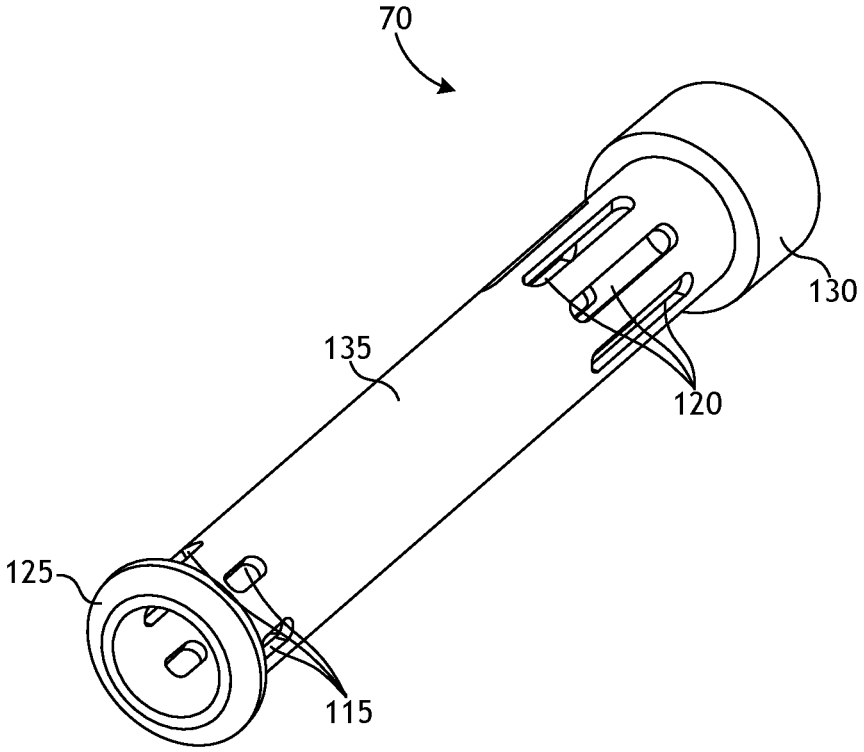
FIG. 13 is a perspective view of an internal flow tube.
Figure 14:
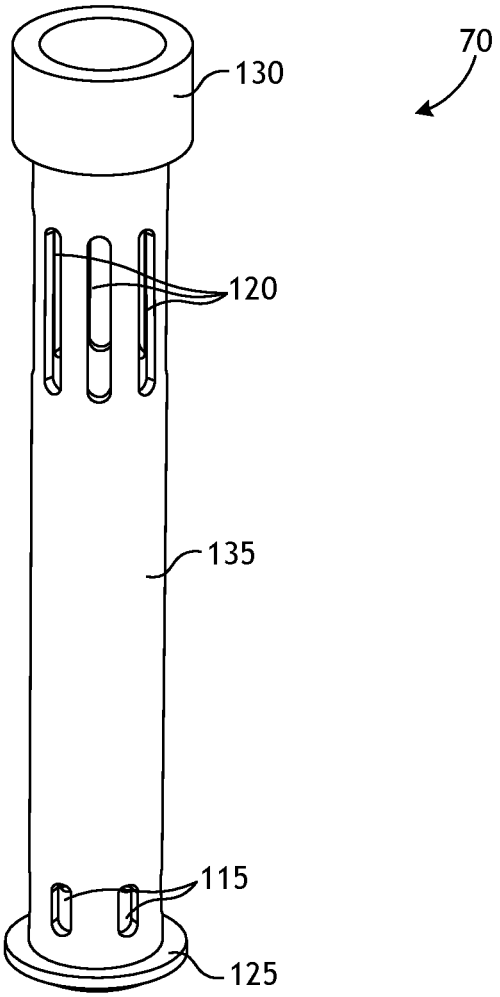
FIG. 14 is a perspective view of an internal flow tube.
Figure 15:
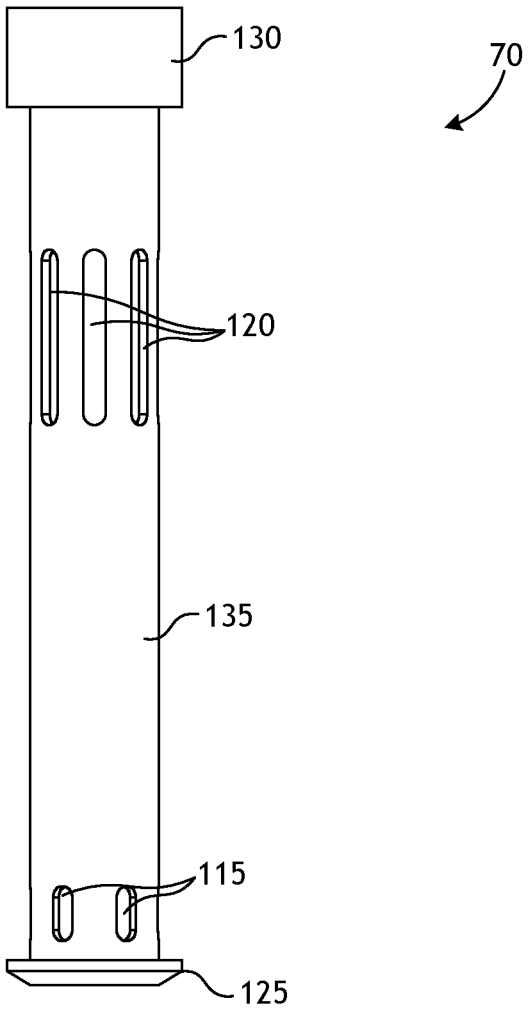
FIG. 15 is a front view of an internal flow tube.
Figure 16:
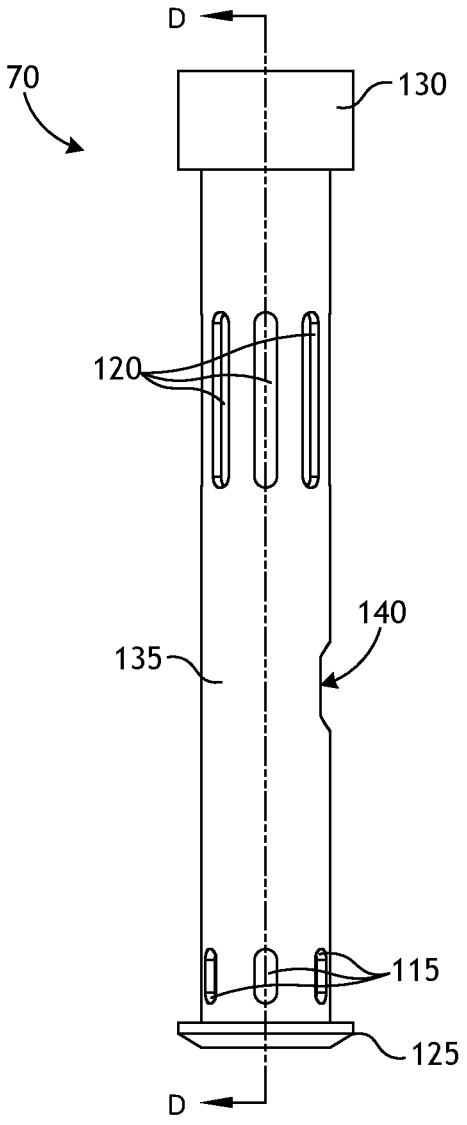
FIG. 16 is a side view of an internal flow tube.
Figure 17:
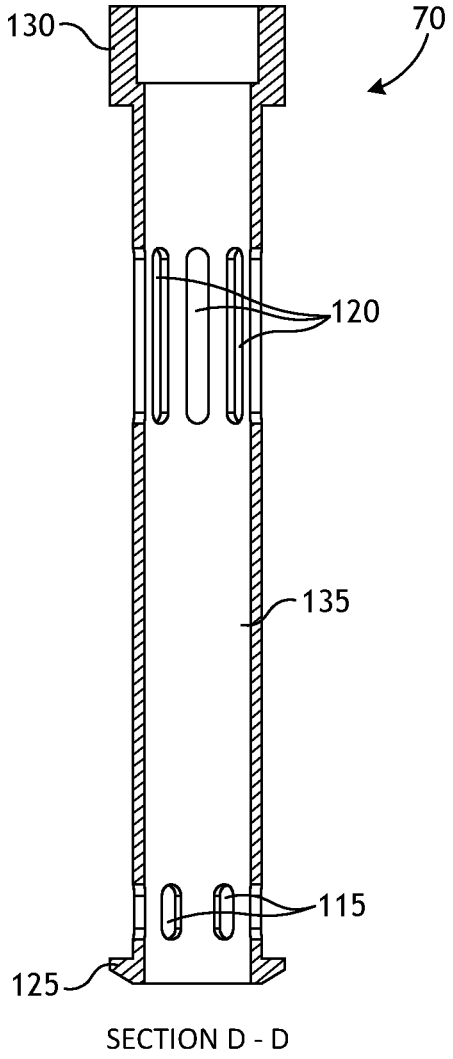
FIG. 17 is a cross-section along section line D-D of the internal flow tube shown in FIG. 16.

FIGS. 12-16 illustrate an exemplary embodiment of internal flow tube 70. FIG. 12 is a perspective view of an internal flow tube; FIG. 13 is another perspective view of the internal flow tube; FIG. 14 is another perspective view of the internal flow tube; FIG. 15 is a front view of the internal flow tube; FIG. 16 is a side view of the internal flow tube; and FIG. 17 is a cross-section along section line D-D of the internal flow tube shown in FIG. 16.

As more specifically shown in FIG. 12, one exemplary embodiment of internal flow tube 70 includes base 125, body 135, and neck 130. In an embodiment, base 125 is formed to fit in lubricator 110 so as to form a substantially leak proof seal around its base so that substantially all of the flow entering flow tube 70 flows through the bore of internal flow tube 70 and/or out lower outlet ports 115. Likewise, in an embodiment, neck 130 is formed to fit in lubricator 110 so as to form a substantially leak proof seal around its neck so that substantially all of the flow from the well that reaches neck 130 flows out through upper outlet ports 120. Other flows are contemplated and are within the scope and spirit of the disclosed invention.

Upper outlet ports 120 and lower outlet ports 115 can vary in number, size, and location. For example, while the embodiment of FIGS. 12-16 show a plurality of upper outlet ports 120 and a plurality lower outlet ports 115, the number of ports (both upper and lower) can vary from one to many. Likewise, the relative size of the ports can vary from the same to different. In a preferred embodiment, however, it is preferred that the upper outlet ports support a higher volume of flow than the lower outlet ports, as FIGS. 12-16 illustrate. This can assist in promoting flow to the top of the lubricator, thereby assisting in pushing a plunger all the way to the top of the lubricator (or at least as far up the lubricator as optimally desired) and/or ensuring that the plunger is caught by a catcher. Still further, the location of the upper outlet ports 120 and the lower outlet ports 115 can vary from being located at the upper and lower portions, respectively, of the internal flow tube 70 to locations in between. In a preferred embodiment, such as that shown in FIG. 11, at least the lower outlet ports 115 are substantially aligned with the bore of outlet flange 20. Nevertheless, other embodiments are possible, such as embodiments where the lower outlet ports 115 are located either above or below the bore of outlet flange 20.

The inside diameter of internal flow tube 70 also can be important in certain embodiments. For example, in embodiments in which an artificial lift device, such as a plunger, is used, the inside diameter of internal flow tube 70 can be sufficiently large so as to accommodate at least part of the plunger in some embodiments and all of the plunger in other embodiments. Likewise, the length of internal flow tube 70 can be important in other embodiments. For example, the length of internal flow tube 70 can be sufficiently long so as to accommodate at least part of the plunger in some embodiments and all of the plunger in other embodiments. In a preferred embodiment, the bottom of the plunger should rest above the lower outlet ports 115 when the plunger is at its upper most position in the lubricator, i.e., where it is held by a catcher device if such device is being used.

In such embodiments including a catcher for an artificial lift device (see e.g. catcher 145 in FIGS. 8-10), the internal flow tube 70 also can include a catcher facility (such as catcher facility 140 shown in FIG. 16) that will interact with a catcher on the lubricator for holding the artificial lift device in place in the lubricator. Such facility could include a number of embodiments, including a hole in internal flow tube 70 through which the catcher can pass for contact with (and to hold) the artificial lift device inside internal flow tube 70 (and in lubricator 110).

Figure 18:
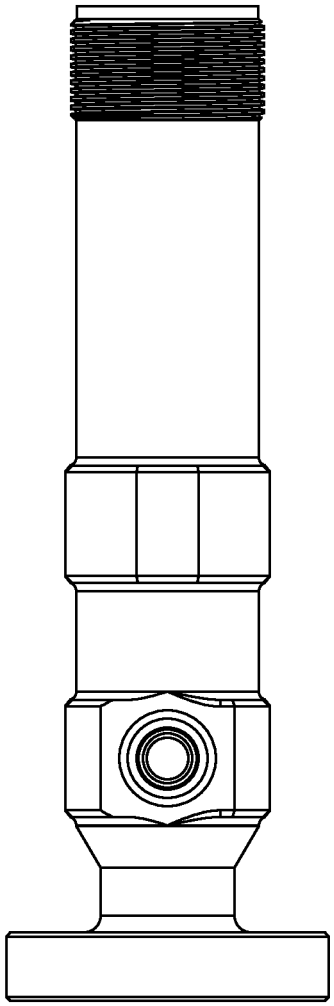
FIG. 18 is a front view of a new lubricator.

FIG. 18 is a front view of a lubricator illustrating an embodiment in which the cap (not shown) is connected by a threaded connection. Those skilled in the art will appreciate that other connections are possible and are within the scope and spirit of the present invention. The removable nature of the cap (such as cap 60 shown in FIG. 11) allows access to the internal components of the lubricator, such as anvil 65, end cap spring 80, and internal flow tube 70 (as shown in FIG. 11).

Figure 19:
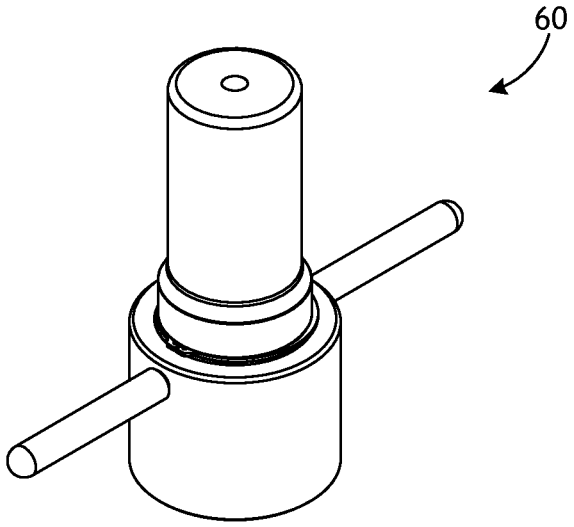
FIG. 19 is an upper component of the new lubricator shown in FIG. 11.

FIG. 19 is an upper component (or in this case cap 60) of an embodiment of the lubricator shown in FIG. 11. Various configurations of cap 60 are possible and each is within the spirit and scope of the present invention. As indicated above, the primary purpose of the cap (for purposes of certain embodiments of the present invention) is to provide ready access to the internal components of the lubricator, such as anvil 65, end cap spring 80, and internal flow tube 70 (as shown in FIG. 11).

Figure 20:
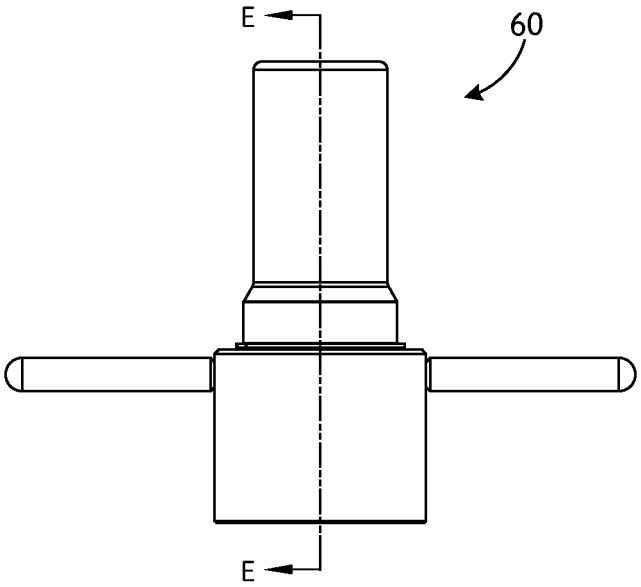
FIG. 20 is a front view of the upper component shown in FIG. 19.
Figure 21:
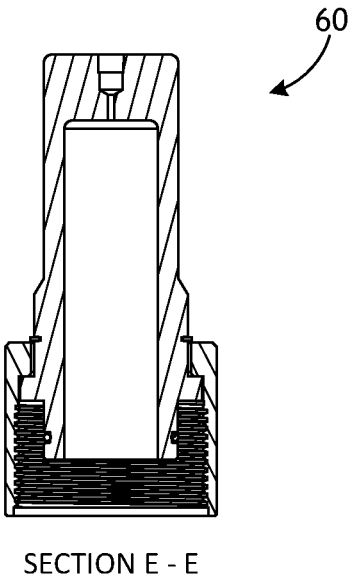
FIG. 21 is a cross-section along section line E-E of the upper component shown in FIG. 20.

FIG. 20 is a front view of the upper component shown in FIG. 19, and FIG. 21 is a cross-section along section line E-E of the upper component shown in FIG. 20. As those skilled in the art will appreciate, FIG. 21 shows an embodiment including threads for mating with the treads shown in FIG. 18 to thereby form a threaded connection for maintaining cap 60 on the lubricator.

Figure 22:
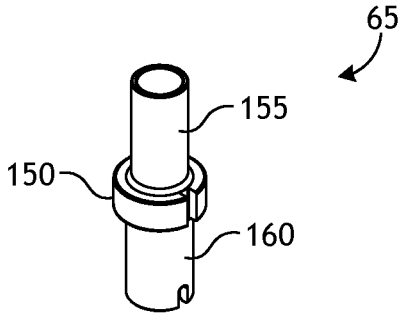
FIG. 22 is a component of the new lubricator shown in FIG. 11.

FIG. 22 is a component (or in this case anvil 65) of an embodiment of the lubricator shown in FIG. 11. Various configurations of anvil 65 are possible and each is within the spirit and scope of the present invention. In this particular embodiment, anvil 65 includes collar 150, upper section 155, and lower section 160. As shown in connection with the embodiment of FIG. 11, upper section 155 sits inside a lower portion of end cap spring 80 so that the bottom of the end cap spring rests on the top of collar 150. Collar 150 divides anvil 65 between its upper section 155 and its lower section 160. In this embodiment, lower section 160 is sized to fit within an upper portion of internal flow tube 70, as shown in FIG. 11. Accordingly, the various dimensions of anvil 65 in this particular embodiment are such that the outside diameter of upper section 155 is smaller than the inside diameter of end cap spring 80, and the outside diameter of lower section 160 is smaller than the inside diameter of internal flow tube 70. The outside diameter of upper section 155 and the outside diameter of lower section 160 may or may not be the same. In either event, in this particular embodiment, the outside diameter of collar 150 is greater than the outside diameter of both upper section 155 and lower section 160. As noted above, anvil 65 may also include a reset rod (not shown) in some embodiments.

Figure 23:
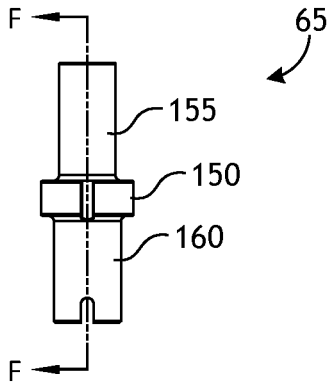
FIG. 23 is a front view of the component shown in FIG. 22.
Figure 24:
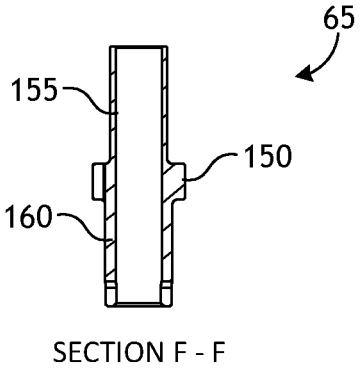
FIG. 24 is a cross-section along section line F-F of the component shown in FIG. 23.

FIG. 23 is a front view of the component shown in FIG. 22, and FIG. 24 is a cross-section along section line F-F of the component shown in FIG. 23.

Figure 25:
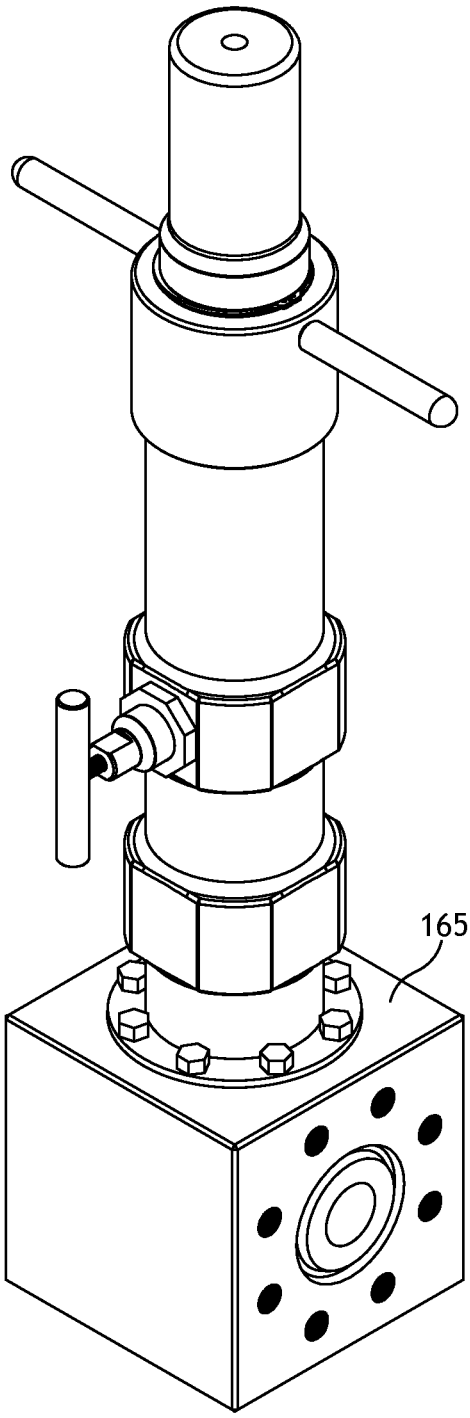
FIG. 25 is a perspective view of a new lubricator with a flow block.
Figure 26:
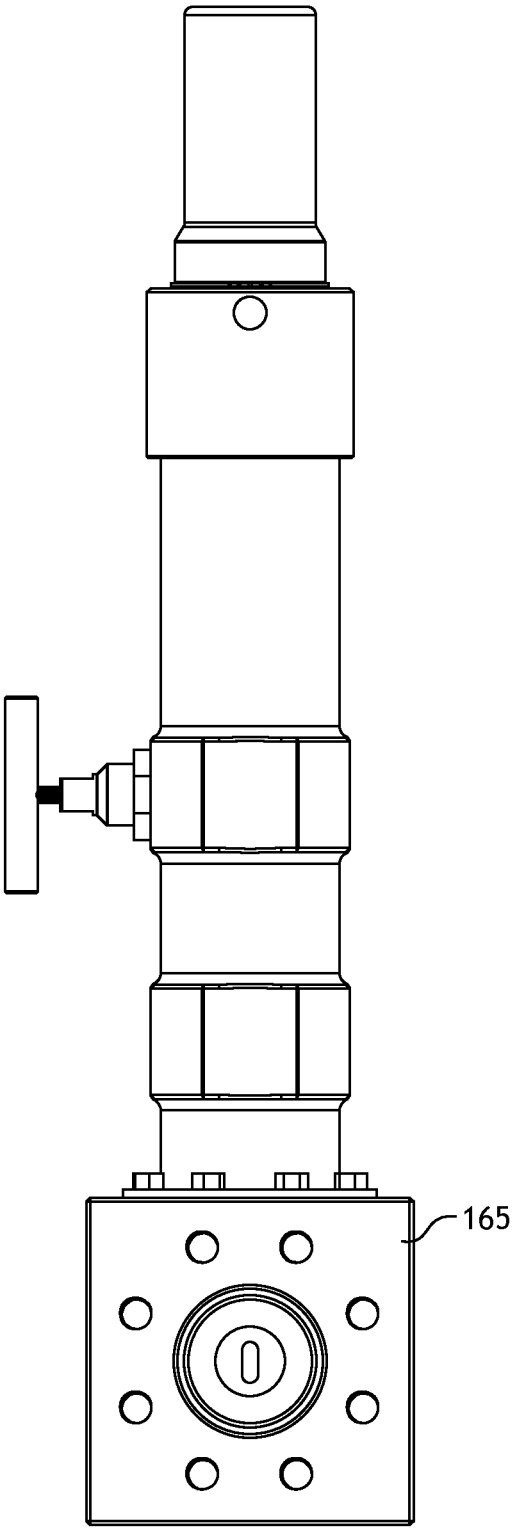
FIG. 26 is a left side view of a new lubricator with a flow block.
Figure 27:
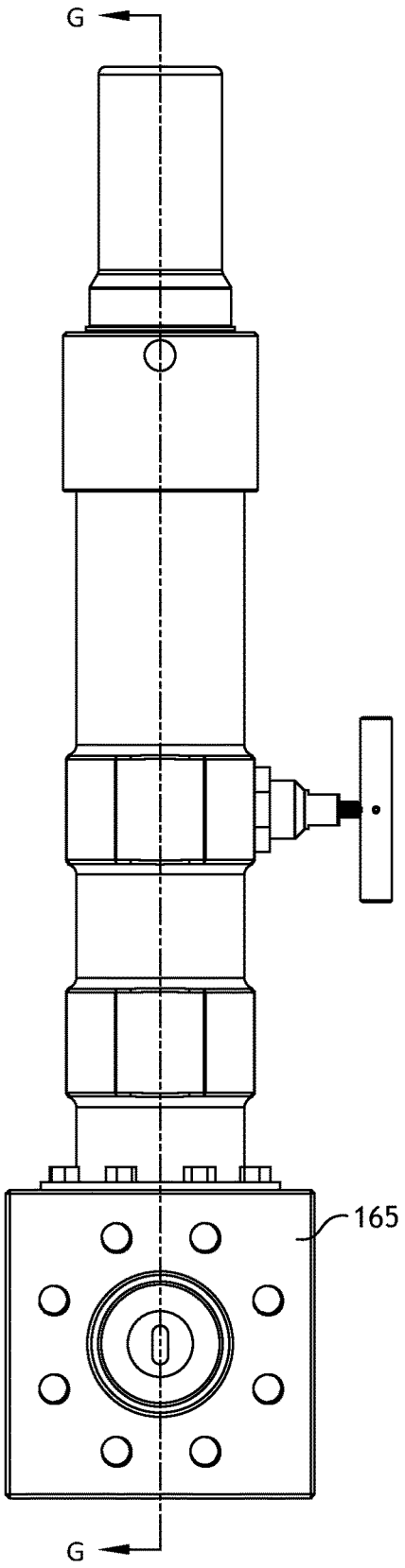
FIG. 27 is a right side view of a new lubricator with a flow block.
Figure 28:
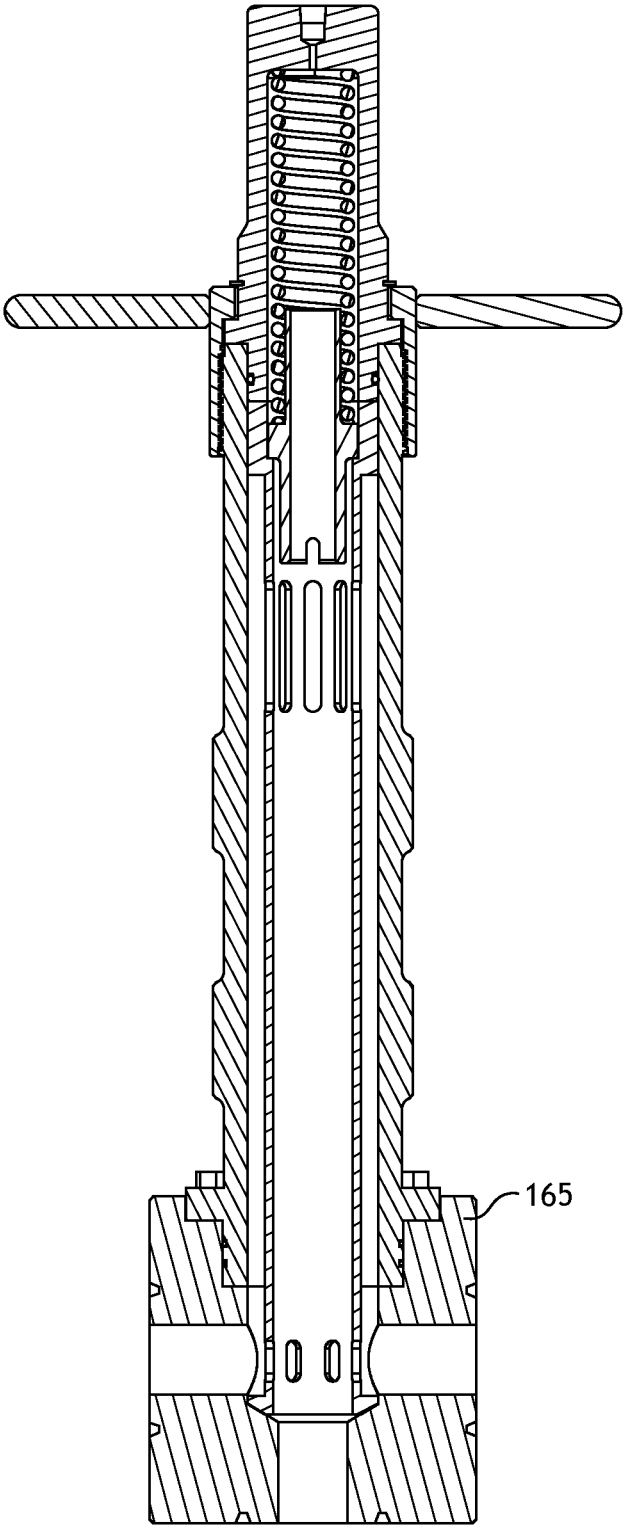
FIG. 28 is a cross-section along section line G-G of the new lubricator shown in FIG. 27.

FIG. 25 is a perspective view of a new lubricator with flow block 165. As those skilled in the art will appreciate, flow block 165 is used here as opposed to inlet flange 40 shown in FIG. 11. The remaining details of the lubricator are substantially the same as those described in FIGS. 8-24. FIG. 26 is a left side view of the lubricator with a flow block as shown in FIG. 25. FIG. 27 is a right side view of the lubricator with a flow block as shown in FIG. 25. FIG. 28 is a cross-section along section line G-G of the lubricator shown in FIG. 27. As noted in FIG. 28, flow block 165 is shown as having two outlet ports, one on the right and one on the left. (The flow block is also shown having an outlet that flows into the lubricator.) The number of outlet ports is optional and, therefore, a design choice available to the end user. Likewise, while not shown in detail in the Figures, the embodiments of FIGS. 8-11 may have more than one outlet port 30 similar to that of the outlet ports in FIG. 28.

An additional feature and advantage of some embodiments of the present invention is the ease by which the internal components, namely the internal flow tube 70, can be accessed for cleaning and/or replacement. Replacement of internal flow tube 70 can be made for a variety of reasons, including to replace a worn internal flow tube and/or to replace an existing flow tube with a flow tube having a different arrangement/size of ports to affect flow in the lubricator. As shown in FIGS. 11 and 28, internal flow tube 70 can be accessed by simply removing cap 60, end cap spring 80, and anvil 65. While the present invention is not limited to removing only those components to access internal flow tube 70, the relative ease of access is a distinct advantage the certain embodiments of the present invention afford over the prior art.

Although the invention(s) is/are described herein with reference to specific embodiments, various modifications and changes can be made without departing from the scope of the present invention(s), as set forth in the claims below. Accordingly, the specification and Figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

Accordingly, the protection sought herein is as set forth in the claims below.

The invention claimed is:

1. A lubricator, comprising:

a body having a central bore extending at least between an upper end and a lower end of the body, where the body's central bore includes a first inside diameter, a second inside diameter, and a transition between the first and the second inside diameter, wherein the transition between the first and the second inside diameter is located in the lower end of the body and forms a support seat that supports a lower end of an internal flow tube in at least a portion of the body's central bore;

the internal flow tube having a central bore extending at least between an upper end and the lower end of the internal flow tube, the internal flow tube also having a first outside diameter where the first outside diameter is sized relative to the first inside diameter of the body's central bore such that at least part of the internal flow tube slides in the body's central bore at least partially between the body's upper end and the body's support seat, the lower end of the internal flow tube including a base having the internal flow tube's first outside diameter which is larger than the second inside diameter of the body's central bore so that at least part of the internal flow tube's first outside diameter rests on the body's support seat and the support seat supports the internal flow tube in the body's central bore by preventing the internal flow tube from sliding in the body's central bore below the body's support seat, but allowing the internal flow tube to slide in the body's central bore toward the body's upper end;

a first flow path located in the central bore of the internal flow tube; and a second flow path located between the internal flow tube and a sidewall of the body's central bore.

2. The lubricator of claim 1 wherein the internal flow tube is removable from the lubricator.

3. The lubricator of claim 2 wherein the internal flow tube includes at least one lower outlet port.

4. The lubricator of claim 3 wherein the internal flow tube includes at least one upper outlet port.

5. The lubricator of claim 4 wherein at least a portion of the first flow path is between the lower outlet port of the internal flow tube and the upper outlet port of the internal flow tube.

6. The lubricator of claim 5 including an exit port.

7. The lubricator of claim 6 including a third flow path located between the lower outlet port of the internal flow tube and the exit port of the lubricator.

8. The lubricator of claim 7 wherein at least a portion of the second flow path is between an outlet of the upper outlet port of the internal flow tube and the exit port of the lubricator.

9. The lubricator of claim 8 wherein the internal flow tube includes an inside diameter sufficient to receive at least a portion of an artificial lift device.

10. The lubricator of claim 9 wherein the upper outlet port of the internal flow tube is sized and configured to permit a higher volume of flow than the lower outlet port of the internal flow tube.

11. The lubricator of claim 10 wherein the lower outlet port of the internal flow tube is substantially aligned with the exit port of the lubricator.

12. The lubricator of claim 11 configured to receive flow from a well such that at least a portion of said flow enters a lower portion of the lubricator, then enters a lower portion of the internal flow tube, then at least a portion of said flow travels in the first flow path from the lower port of the internal flow tube to the upper port of the internal flow tube, then flows out the upper port of the internal flow tube and into the second flow path, and then travels in the second flow path to the exit port of the lubricator.

13. The lubricator of claim 12 wherein at least a portion of said flow from the well travels in the third flow path.

14. The lubricator of claim 13 wherein the base at the lower end of the internal flow tube interfaces with the support seat in the body's central bore such that substantially all of the flow from the well is directed into the internal flow tube.

15. The lubricator of claim 14 further including a removable cap.

16. The lubricator of claim 15 further including an anvil.

17. The lubricator of claim 16 further including an end cap spring.

18. The lubricator of claim 17 wherein the internal flow tube further includes a catcher facility.

19. A lubricator and flow block combination, comprising:

a lubricator having a central bore extending at least between an upper end and a lower end of the lubricator;

a flow block having a central bore extending at least between an upper end and a lower end of the flow block, where the central bore of the flow block is in fluid communication with the central bore of the lubricator, wherein the central bore of the flow block includes a first inside diameter, a second inside diameter, and a transition between the first and the second inside diameter, wherein the transition between the first and the second inside diameter forms a support seat in the flow block that supports a lower end of an internal flow tube positioned in at least a portion of the lubricator's central bore and the flow block's central bore;

the internal flow tube having a central bore extending at least between an upper end and a lower end of the internal flow tube, the internal flow tube also having a first outside diameter where the first outside diameter is sized relative to the first inside diameter of the lubricator's central bore and the flow block's central bore such that at least part of the internal flow tube slides in the lubricator's central bore and the flow block's central bore at least partially between the lubricator's upper end and the flow block's support seat, the lower end of the internal flow tube including a base having the internal flow tube's first outside diameter which is larger than the second inside diameter of the flow block's central bore so that at least part of the internal flow tube's first outside diameter rests on the flow block's support seat and the flow block's support seat supports the internal flow tube in the lubricator's central bore and in the flow block's central bore by preventing the internal flow tube from sliding in the flow block's central bore below the flow block's support seat, but allowing the internal flow tube to slide in the lubricator's central bore toward the lubricator's upper end;

a first flow path located in the central bore of the internal flow tube; and a second flow path located between the internal flow tube and a sidewall of the lubricator's central bore.

20. The combination of claim 19 wherein the internal flow tube is removable from the lubricator.

21. The combination of claim 20 wherein the internal flow tube includes at least one lower outlet port.

22. The combination of claim 21 wherein the internal flow tube includes at least one upper outlet port.

23. The combination of claim 22 wherein at least a portion of the first flow path is between the lower outlet port of the internal flow tube and the upper outlet port of the internal flow tube.

24. The combination of claim 23 wherein the flow block includes an exit port.

25. The combination of claim 24 including a third flow path located between the lower outlet port of the internal flow tube and the exit port of the flow block.

26. The combination of claim 25 wherein at least a portion of the second flow path is between an outlet of the upper outlet port of the internal flow tube and the exit port of the flow block.

27. The combination of claim 26 wherein the internal flow tube includes an inside diameter sufficient to receive at least a portion of an artificial lift device.

28. The combination of claim 27 wherein the upper outlet port of the internal flow tube is sized and configured to permit a higher volume of flow than the lower outlet port of the internal flow tube.

29. The combination of claim 28 wherein the lower outlet port of the internal flow tube is substantially aligned with the exit port of the flow block.

30. The combination of claim 29 configured to receive flow from a well such that at least a portion of said flow enters a lower portion of the flow block, then enters a lower portion of the internal flow tube, then at least a portion of said flow travels in the first flow path from the lower port of the internal flow tube to the upper port of the internal flow tube, then flows out the upper port of the internal flow tube and into the second flow path, and then travels in the second flow path to the exit port of the flow block.

31. The combination of claim 30 wherein at least a portion of said flow from the well travels in the third flow path.

32. The combination of claim 31 wherein the base at the lower end of the internal flow tube interfaces with the support seat in the central bore of the flow block such that substantially all of the flow from the well is directed into the internal flow tube.

33. The combination of claim 32 wherein the lubricator further includes a removable cap.

34. The combination of claim 33 wherein the lubricator further includes an anvil.

35. The combination of claim 34 wherein the lubricator further includes an end cap spring.

36. The combination of claim 35 wherein the internal flow tube further includes a catcher facility.

* * * * *